United States Patent [19]

Bryant

[11] 4,137,440

[45] Jan. 30, 1979

[54] ELECTRICAL SWITCH

[75] Inventor: Stanley Bryant, Taree, Australia

[73] Assignee: Bryant Manufacturing Pty. Limited, Taree, Australia

[21] Appl. No.: 810,865

[22] Filed: Jun. 28, 1977

[30] Foreign Application Priority Data

Jul. 7, 1976 [AU] Australia ..... PC6558

[51] Int. Cl.[2] ..... H01H 3/12;

[52] U.S. Cl. ..... 200/159 R; 200/16 B; 200/164 R; 200/61.89; 200/161

[58] Field of Search ..... 200/16 R, 16 B, 16 C, 200/16 D, 159 R, 159 A, 161, 164 R, 164 A, 295, 303, 61.89

[56] References Cited

U.S. PATENT DOCUMENTS

| | | | |
|---|---|---|---|
| 1,909,585 | 5/1933 | Jacobi | 200/16 D |
| 2,575,147 | 11/1951 | Unsworth | 200/164 R X |
| 3,275,768 | 9/1966 | Batcheller | 200/164 R X |
| 3,408,464 | 10/1968 | Earleywine, Jr. et al. | 200/61.89 X |
| 3,412,225 | 11/1968 | Rogers et al. | 200/295 X |
| 3,546,402 | 12/1970 | Spaeth et al. | 200/16 D |
| 3,567,891 | 3/1971 | Hinkelmann | 200/16 D X |

FOREIGN PATENT DOCUMENTS

| | | | |
|---|---|---|---|
| 1040434 | 8/1966 | United Kingdom | 200/16 B |

*Primary Examiner*—Herbert F. Ross

*Attorney, Agent, or Firm*—Darby & Darby

[57] ABSTRACT

An electrical slide switch is disclosed which requires no springs to maintain pressure for electrical contact. The switch includes a slidable plunger on which a carrier with an open top is mounted and a contact plate is mounted on top of the carrier. The contact plate includes fingers with downwardly entering contact and an upwardly extending pressure member integral with the plate. The carrier is provided with a hinged lid to close its top and the upwardly extending pressure member is positioned to engage the lid when it is closed. The engagment between the lid and pressure member results in a downwardly force being applied to the pressure member. This downwardly force is transmitted to the fingers, thereby providing sufficient pressure for effective electric contact and cleaning of the contact due to scrubbing.

11 Claims, 6 Drawing Figures

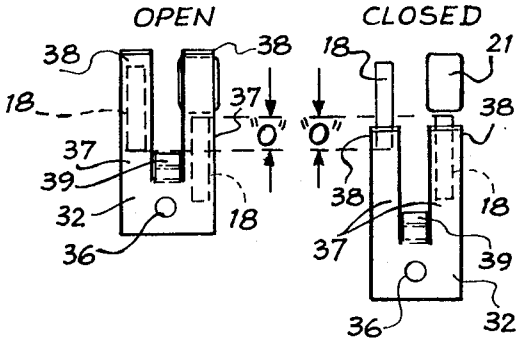
FIG. 3
FIG. 2
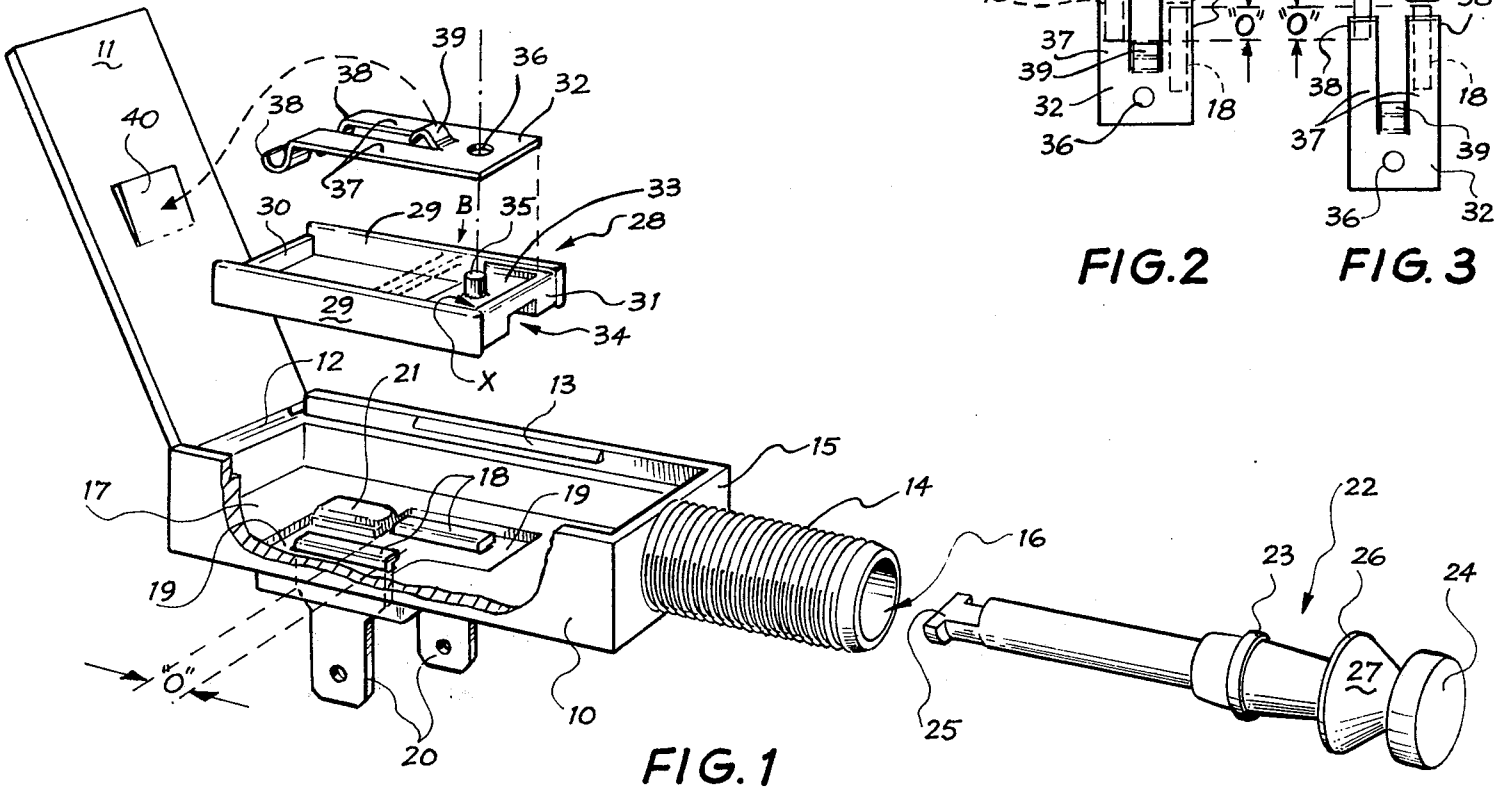
FIG. 1

ELECTRICAL SWITCH

This invention relates to switches and provides a low cost multi-function switch which may be easily assembled and in which the switching action takes place with a contact-scrubbing movement thereby cleansing the contacts. Therefore high or low currents can be switched whilst still providing high reliability and long life for the switch. Furthermore complicated switching functions may be provided at low cost.

In some applications it is essential that not only high currents be switched but also that the switch itself be of low cost and yet be sufficiently reliable that the switch operates effectively for the entire life of the apparatus in which the switch is installed. For example, the switch required to operate the stop lamps of a motor vehicle is required to conduct an appreciable current, of the order of several amps. The switch is also required to be operated repeatedly, and yet must have an operating life of approximately the expected life of the vehicle. Futhermore the ever present pressure of rising costs ensures that there is a continual demand for a switch meeting the required functional specification but which is able to be assembled and manufactured at low cost. It is the object of the present invention to provide a switch, the preferred embodiment of which substantially meets the abovementioned objectives.

According to the invention, the switch comprises: an open-topped housing; a lid adapted to close the housing top; tubular mounting means for the housing formed on and projecting from one end of the housing; a plurality of contact pieces mounted in the housing base, said contact pieces including contact blocks projecting into the housing in transversely spaced, parallel relationship and integral terminals projecting out of the housing base; a plunger mounted for longitudinal sliding movement in the mounting means, said plunger having one of its ends projecting from the mounting means for engagement by a source of power and having its other end located within the housing; a contact connector assembly releasably mounted upon the other end of the plunger said connector assembly including at least one metal contact plate which has a plurality of contact fingers extending therefrom corresponding in number to the number and transverse spacing of the contact blocks, said fingers each having a contact formed thereon for engagement with an aligned contact block or blocks; and means on the contact plate engaged by the lid to resiliently bias the fingers towards the housing base; the length of said fingers and of said contact blocks being arranged so as to connect the contacts with and disconnect them from predetermined ones of said contact blocks in a scrubbing movement under the action of said bias in response to longitudinal movement of the plunger.

The present invention will now be described with reference to the annexed drawings, wherein:

FIG. 1 is an exploded perspective view of one form of switch according to the invention.

FIGS. 2 and 3 are diagrammatic plan views showing the open and closed position of the switch of FIG. 1.

Figure 4:
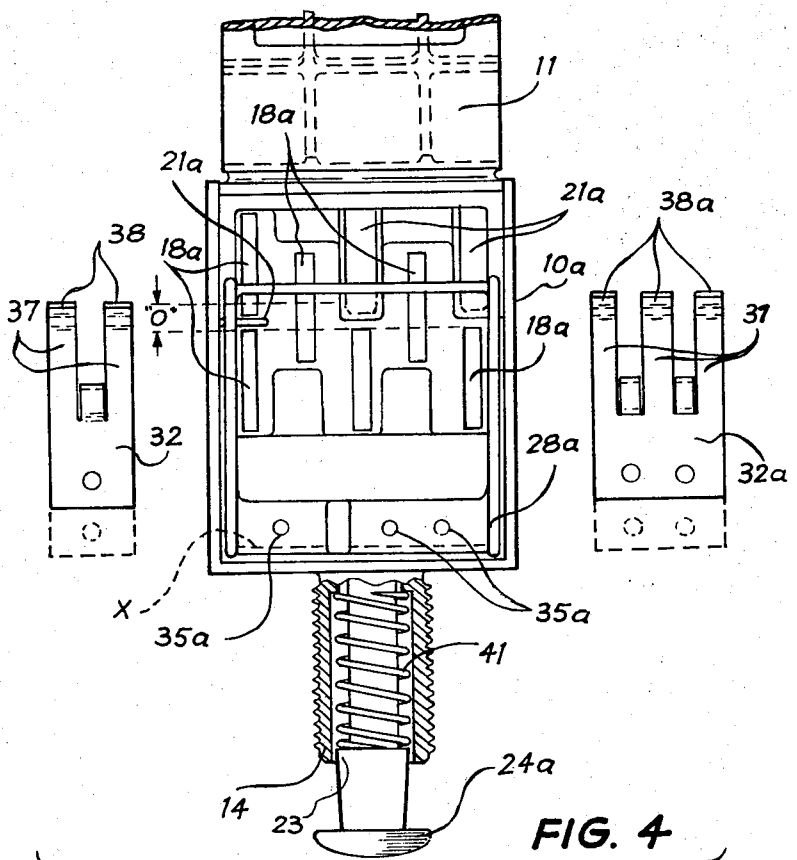

FIG. 4 is a plan view of a modified form of switch, required to be used in connection with the electrical circuits disclosed in co-pending Australian Patent Applications No. 14776/76 and No. PC 9274. The switch, to be operated automatically, in order for the abovementioned circuit to operate correctly, requires a single set of contacts to be closed in order to operate the brake lamp(s) of the vehicle whilst simultaneously a contact connected to a monitor lamp is required to be disconnected from a contact connected to earth and then connected to the ignition of the vehicle in a break-before-make action and incorporating six contact fingers and six contact pieces and showing the contact fingers removed from the housing.

Figure 5:
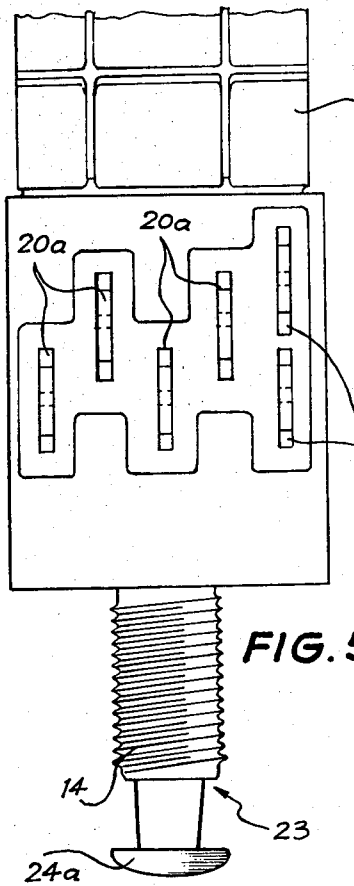

FIG. 5 is an inverted plan view of the switch of FIG. 4, and

Figure 6:
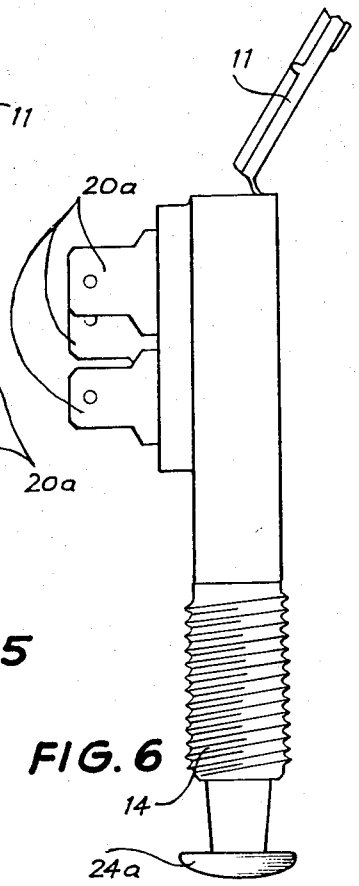

FIG. 6 is an elevational view thereof.

The switch comprises a slim, rectangular, open-topped housing 10 moulded from a suitable dielectric plastics materials. A dielectric lid 11 as shown, is integrally moulded with the body 10 at one end of said body 10 and is connected thereto by a hingeing flap 12. So that the lid 11 can be secured in a snap-closed position over the open top of the housing 10, a tapered flange 13 is formed on the inside of one wall of the housing. The lid 11 when being closed, slides over and past the flange 13 and becomes captive therebeneath.

Mounting means for securing the body 10 upon a suitable support (not shown), comprises a tubular, externally screwed socket 14 formed integrally with and on the other end 15 of the housing 10. The socket 14 has a smooth bore 16 which communicates with the interior of the housing 10 through an opening formed through the housing end 15.

The base 17 of the housing 10 has contact pieces moulded thereinto, and the contact pieces consist of contact blocks 18 projecting into the housing 10 in a suitably shaped recess or recesses 19 formed in said base 17, and terminals 20 projecting out of the housing 10. The terminals 20 may be formed as desired, e.g. flat, round or screw-type. The contact blocks 18 as shown in FIG. 1 are two in number and they are located in parallel spaced relationship and they overlap longitudinally as indicated at "O". Also, a dielectric block 21, formed integrally with the base 19 to a preferred height and in alignment with the adjacent contact block 18, has a length dimension approximating that of the overlap "O", as one method of controlling a break-before-make.

The contact blocks 18 - terminals 20 are secured into the base 17 of the housing 10 and as will be apparent, the height of the contact blocks 18 in the housing 10, must be maintained within fine tolerance limits. To effect this, suitably located and spaced openings are formed through base 17 during the moulding operation, and they are so dimensioned that the terminals 20 are initially pushed through said openings. The housing 10 having terminals 20 located therein is positioned in a nest. As the initial step of a securing operation, the head of a press, such as a welding head, is lowered and presses the terminals 20 into engagement with a lower limit stop and at the same time the head engages the upper surface of the base 17 of housing 10, which acts as an upper limit stop, to accurately fix the contact blocks 18-terminals 20 in the housing 10, during a subsequent securing operation. The contact blocks 18-terminals 20 are externally shaped or roughened to provide firm anchorage thereof in the base 17 when in their secured position.

As illustrated in FIG. 1, a plunger 22 — in this embodiment a push-pull plunger moulded from a suitable dielectric plastics material — has formed integrally thereon a stem part 23 slidable in the bore 16 of socket 14, a head 24 on one end thereof adapted to project from a vehicle dashboard, for manual actuation of the plunger, and a T-shaped connector 25 formed on the other (reduced diameter) end thereof. The stem part 23 is a bearing surface and it is comparatively narrow. Between the bearing surface 23 and head 24, the plunger is slightly tapered where it extends to a shoulder 26. This arrangement encourages dust to settle on the tapered part, thus preventing seizing of the bearing surface 23 in the socket 16 as the switch is operated. The plunger 22 projects through the socket 14 with the connector 25 located in the housing 10. As illustrated, a further tapered portion 27 is formed between the shoulder 26 and head 24, to provide a finger grip. Instead of the tapered part 27 and head 24, this end of the plunger may be screwed to receive a cap. The cap can be individually designed and may carry an approved recognition symbol.

The length of the plunger between shoulder 26 and the inner end thereof is accurately predetermined relative to the positioning of the contacts 18 within the housing 10, in that this length dimension controls the amount of movement of carrier 28 in the housing 10.

The plunger end 25 is adapted to be releasably connected to a contact connector assembly which includes carrier 28 slidably mounted in the housing 10 on the base 17 thereof. The carrier 28 is also moulded from a suitable dielectric plastics material and it includes two sides 29 externally width dimensioned to fit neatly but slidably, and to be accurately guided in the housing 10, by and between the sides of the housing 10. In this arrangement, the sides 29 of the carrier, or the sides of the housing 10 may be provided with raised bearing surfaces to minimise friction and provide dust cavities therebetween, to prevent the carrier seizing in the housing. As illustrated, an end 30 forming a brace for the sides at the inner end of the carrier 20 is provided, but this construction may be modified as will hereinafter be explained. A mounting end 31 adapted to be connected to the plunger connector end 25, is also provided. The carrier 28 is also adapted to removably support a contact plate 32. For this purpose, the mounting end 31 of carrier 28 includes an integral body part 33 having a T-shaped, ball shaped, or other suitably shaped coupling slot indicated at 34 to couple the end 25 of plunger 22, formed in the underside thereof. Also, as illustrated, an integral peg 35 is formed upstanding from the body part 33. To connect the plunger 22 to the carrier 28, the plunger is mounted in the socket with the end 25 thereof located in the housing. The carrier 28 is then mounted on the plunger 22 by fitting the said end 25 of the plunger into the T-shaped slot 34. The T-shaped slot 34 can be varied in shape, as it is provided to give a captive arrangement for plunger 22, which can likewise be shape-modified. The carrier 28 also has an open bottom, located as illustrated between the end 30 and the inner end of the body part 33 thereof, for reasons to be explained.

As illustrated, the contact plate 32 has a hole 36 formed therethrough whereby it is mounted upon the peg 35 of the carrier 28 in engagement with the upper surface of the body part 33 of said carrier. The contact plate 32 includes a pair of spring contact figures 37 thereon each having a downwardly projecting contactor 38 of U-shape formed on the end thereof, and an upwardly projecting, U-shaped pressure member 39 formed thereon between the inner ends of the fingers 37. The contacts 38 are located and arranged to project downwardly through the open bottom of the carrier 28 for sliding engagement with the contact blocks 18, and the right-hand contact 38 also has sliding engagement with the dielectric block 21. To hold the contacts in firm sliding engagement with the blocks 18 and 21, a ramped pressure plate 40 is formed on the inner surface of the lid 11. When the various components of the switch so described have been assembled and the said lid 11 is closed, the pressure plate 40 engages the pressure member 39 and holds the contacts 38 in a preselected position.

As an alternative means of mounting the contact plate 32 on the carrier 28, the said carrier 28 has a transverse groove or slot formed across the body part 33 where indicated at X, FIG. 1 and the corresponding end of the contact plate 32 is formed as a hook to be received in the groove or slot. Also, a bridge B is formed adjacent the body part 33 across the carrier 28 or as oppositely disposed projections formed within carrier 28, and the contact plate when "hooked" into the groove or slot, is disposed beneath the bridge B. This tensions the contact fingers 37 as the lid is closed over the housing 10 and firmly clamps the contact plate upon the carrier.

The embodiment illustrated in FIGS. 4, 5 and 6 may be adapted to be operated as for the embodiment of FIGS. 1, 2 and 3, but as illustrated, it is operated by the vehicle brake pedal (the power source). The housing **10*a* is enlarged to accommodate a carrier 28*a* which has three mounting pegs 35*a* or two grooves or slots X formed thereon, whereby the carrier 28*a* supports a contact plate 32 having two contact fingers 37 and contacts 38 thereon as previously described, and also supports a second contact plate 32*a* having three contact fingers 37*a* and contacts 38*a* thereon. In this embodiment, the housing has six contact blocks 18*a* and six terminals 20*a* moulded thereinto and also has three integral dielectric blocks 21*a* upstanding from the base 17 thereof. In addition, the plunger 22 is biassed to outward position seen in FIG. 4 by a compression spring 41 mounted thereon. The spring 41 is located between shoulders formed one adjacent the plunger head 24*a* and the other within the body part of the carrier 28*a*. The plunger head 24*a* is adapted to be operatively engaged by the power source to push the plunger into the housing and is automatically biassed outwardly of the housing by the spring 41**.

As an alternative function of the switch of this invention, the carrier 28 or **28*a* may be adapted to be operated from each end. For example, for the carrier 28, the plunger 22 provides a manual switching operation and the other end of said carrier provides an automatic switching operation which will automatically actuate the switch in the case of collision or sudden severe braking of the vehicle, so that the vehicle hazard warning lights will come on to warn that a hazardous situation has arisen. The said other end of carrier 22** may be connected by a link and lever arrangement to an actuating source such as an inertia force, or it may be operated manually, mechanically, electrically or by vacuum.

The longitudinal extent and precise location of the contact blocks **18-18*a* in the housing 10-10*a*, together with the length of the contact fingers 37-37*a* of each contact plate 32-32*a*, determine which contact blocks are connected and which contact blocks are disconnected by the contacts 38-38*a*** for each "in" or "out" position of the plunger.

As the plunger is moved, a contact of each finger rubs either against the adjacent dielectric block **21-21*a* or against the corresponding contact block 18-18*a*. The engagement of the fingers with the dielectric blocks holds the finger steady and prevents the plate 32-32a** from rocking. Accordingly a contact-scrubbing action is achieved as electrical contact is made and broken. This enables any deposits built up on the contact blocks or the contacts, as a result of arcing caused by heavy current flow, or any other dirt or impurity, to be wiped from the contact blocks and contacts each time the electrical contact is made. In this way reliable switching action is achieved, with the contact blocks abutting the contacts of each individual contact plate being simultaneously connected.

One particular advantage of the embodiment of FIGS. 3, 4 and 5 is that the longitudinal spacing of the outer contact blocks may be selected so as to provide only approximately a two thousanths of an inch spacing between them. Accordingly it is exceedingly difficult to locate the plunger in a stationary or neutral position which corresponds to no electrical contact being made by the inner contact block with either of the outer contact blocks.

This is particularly advantageous since the operation of the circuit in the abovedescribed patent application requires that the break-before-make switching action be performed so that either one possible connection is made or the other possible connection is made but that there should be as small a position as possible in which the inner contact block remains unconnected. The close longitudinal spacing between the two outer contact blocks achievable with the switch of the present invention means that the plunger must be very precisely positioned in order to achieve the "dead" position in which the inner contact block is not connected to either one of the outer contact blocks. The effective result of this is, that it is a practical impossibility for a service operator during installation or adjustment of the switch relative to the foot brake pedal, to so position the switch that when the foot brake pedal is operated the break-before-make contact is positioned in its "dead" region. This possibility was a serious disadvantage with known prior art switches having the same or similar switching functions.

It will be apparent to those skilled in the art, that the switch constructions described above are very low cost ones in which the few moving pieces of either switch may be easily assembled by unskilled labour. Accordingly the over-all cost of the switches is greatly reduced whilst the reliability and longevity of the switches are greatly enhanced.

Modifications, obvious to those skilled in the art, may be made to the switches as described, without departing from the scope of the present invention. For example, the location of the two above-described outer contact pieces may be longitudinally adjusted so as to provide an overlap or the main current terminal may be positioned to be in sliding contact permanently to eliminate high current make and break arcing particularly when current is diverted to two or more circuits from the switch. In this case the switching function performed is that of make-before-break. Additionally or alternatively the length of the fingers of the connector(s) may be varied to provide different switching functions thereby enabling a standard housing moulding with predetermined positions for the contact pieces to be used for a variety of switching functions, where a multiplurality of circuits used are to be completely open in one position of the switch and closed in another position. Examples of this are hazard warning signals when used in conjunction with vehicle turn signals. Also tests have shown that as wear occurs between the ends of the adjacent contact blocks or adjacent contact blocks and dielectric blocks, due to passage of the contacts thereacross, the contacts tend to deform from U-shape to a somewhat flattened bottom shape and they thus do not have to "jump" across the gaps caused by the wear, but remain supported between the ends of the pairs of adjacent blocks and the gaps have a tendency to remain consistent.

Further, an alternative construction of the lid 11 is envisaged, to prevent bowing of the lid 11 thereby to prevent over or under pressurising of the pressure member 39 of the contact plate 32, by the lid 11. This is achieved by forming the lid 11 as a separate component and welding or otherwise fixing it to the housing 10. To do this, the housing may be provided with a bosslike projection upstanding from the inner surface of the base thereof, and the projection abuts the inner surface of the lid and is welded thereto, when the lid is mounted on the housing 10. Alternatively, the lid 11 may have suitable catch slots formed therethrough and the housing has catch members each with a suitably shaped catch tongue formed on the upper end thereof. When the lid 11 is mounted on the housing 10, the catch tongues project through the catch slots. They lock the lid 11 on the housing 10 and additionally prevent it from bowing.

I claim:

1. A switch comprising: an open-topped housing including a base; a lid adapted to close the housing top; tubular mounting means for the housing formed on and projecting from one end of the housing; a plurality of contact pieces mounted in the housing base, said contact pieces including contact blocks projecting into the housing in tranversely spaced, parallel relationship and integral terminals projecting out of the housing base; a plunger mounted for longitudinal sliding movement in the mounting means, said plunger having one of its ends projecting from the mounting means for application of a moving force and having its other end located within the housing; a contact connector assembly releasably mounted upon the other end of the plunger, said connector assembly including at least one metal contact plate which has a plurality of contact fingers extending therefrom corresponding in number to the number and transverse spacing of the contact blocks, said fingers each having a contact formed thereon for engagement with at least one aligned contact block; and means integrally formed on the contact plate and extending upwardly for engaging the lid when the lid is closed to resiliently bias the fingers towards the housing base; the length of said fingers and of said contact blocks being arranged so as to connect the contacts with and disconnect them from predetermined ones of said contact blocks in a scrubbing movement under the action of said bias in response to longitudinal movement of the plunger.

2. A switch according to claim 1, wherein the mounting means is a cylindrical tubular member which is externally screw-threaded for mounting the housing upon a support.

3. A switch according to claim 1, wherein the plunger includes a stem part slidable in the mounting means, a head on said one end thereof for connection to or engagement by the power source, a connector formed on the other end thereof for releasably connecting the contact connector assembly thereto.

4. A switch according to claim 1, wherein the contact connector assembly includes a carrier slidably mounted in the housing upon the housing base; and said at least one contact plate removably supported upon the carrier; said carrier having an open bottom through which the contacts project for engagement with the contact blocks.

5. A switch according to claim 4, wherein the carrier includes two sides externally width dimensioned to fit neatly but slidably in the housing, one end forming a brace for the sides at the inner end of the carrier, and a mounting end at the outer end of the carrier having a shaped slot formed therein whereby the plunger is releasably connected to the carrier; the open bottom of the carrier extending between the sides thereof and from said one end to the mounting end thereof.

6. A switch according to claim 4, wherein each said contact plate has at least one hole formed therethrough for mounting said contact plate upon at least one registering peg formed on the carrier and upstanding therefrom.

7. A switch according to claim 3, wherein the plunger is a push-pull plunger and the head thereof is adapted to project from a support for manual actuation of the plunger.

8. A switch according to claim 3, wherein the plunger has a compression spring mounted thereon biasing said plunger to an outward position relative to the housing, whereby the plunger is moved into the housing by the power source against the action of said spring and is returned to the outward position by the spring.

9. A switch in accordance with claim 1 wherein said plunger includes a bearing surface intermediate its ends for slidably engaging the interior of said mounting means, said plunger having a tapered portion intermediate said bearing surface and said projecting end which decreases in diameter towards said projecting end.

10. A switch comprising:

an open-topped housing including a base;

a lid adapted to close the housing top; tubular mounting means for the housing formed on and projecting from one end of the housing;

a plurality of contact pieces mounted in the housing base, said contact pieces including contact blocks projecting into the housing in transversely spaced, parallel relationship and integral terminals projecting out of the housing base;

a plunger mounted for longitudinal sliding movement in the mounting means, said plunger having one of its ends projecting from the mounting means for application of a moving force and having its other end located within the housing;

a contact connector assembly releasably mounted upon the other end of the plunger, said connector assembly including at least one metal contact plate which has a plurality of contact fingers extending therefrom corresponding in number to the number and transverse spacing of the contact blocks, said fingers each having a contact formed thereon for engagement with at least one aligned contact block; a ramped block formed integrally upon the inner surface of the lid, and at least one pressure member formed on said connector, said pressure members projecting upwardly from said contact for engagement by the ramped block when the lid is closed;

the length of said fingers and of said contact blocks being arranged so as to connect the contacts with and disconnect them from predetermined ones of said contact blocks in a scrubbing movement under the action of said bias in response to longitudinal movement of the plunger.

11. A switch comprising:

an open-topped housing including a base; a lid adapted to close the housing top; tubular mounting means for the housing formed on and projecting from one end of the housing;

a plurality of contact pieces mounted in the housing base, said contact pieces including contact blocks projecting into the housing in transversely spaced parallel relationship and integral terminals projecting out of the housing base;

a plunger mounted for longitudinal sliding movement in the mounting means, said plunger having one of its ends projecting from the mounting means for application of a moving force and having its other end located within the housing;

a contact connector assembly releasably mounted upon the other end of the plunger and including a carrier releasably mounted to said plunger and disposed in the housing for sliding movement upon the housing base and at least one metal contact plate removably supported upon the carrier, said carrier including two sides externally width-dimensioned to fit neatly but slidably in the housing, a first end forming a brace for the sides at the inner end of the carrier, a mounting end at the outer end of the carrier having a shaped slot formed therein whereby the plunger is releasably connected to the carrier, an open bottom extending between the sides thereof and from said first end to the mounting end thereof through which said contacts project for engagement with said contact blocks, a channel formed transversely across the body part thereof, and a bridge formed therein adjacent said body part, said contact plate having a plurality of contact fingers extending therefrom corresponding in number to the number and transverse spacing of the contact blocks, said fingers each having a contact formed thereon for engagement with at least one aligned contact block, means on the contact plate engaged by the lid to resiliently bias the fingers towards the housing base, and a hook formed thereon for engagement in said channel, said contact plate when so mounted on the carrier being disposed beneath said bridge whereby the contact fingers when tensioned by the lid in its closed position is firmly clamped upon said carrier, the length of said fingers and of said contact blocks being arranged so as to connect the contacts with and disconnect them from predetermined ones of said contact blocks in a scrubbing movement under the action of said bias in response to longitudinal movement of the plunger.

* * * * *